United States Patent [19]

ulinski

[11] Patent Number: 4,867,677

[45] Date of Patent: Sep. 19, 1989

[54] CURTAIN DOOR FOR METAL REHEATING FURNACE

[75] Inventor: Eugene J. Ulinski, Calumet City, Ill.

[73] Assignee: Bethlehem Steel Corporation, Bethlehem, Pa.

[21] Appl. No.: 346,963

[22] Filed: May 3, 1989

[51] Int. Cl.[4] ..... F27D 3/00

[52] U.S. Cl. ..... 432/245; 432/250

[58] Field of Search ..... 432/64, 250, 244, 245

[56] References Cited

U.S. PATENT DOCUMENTS

| | | | |
|---|---|---|---|
| 2,200,619 | 5/1940 | Fallon | 263/6 |
| 3,391,658 | 7/1968 | Williams | 432/245 |
| 3,415,503 | 12/1968 | Beck | 263/8 |
| 3,467,366 | 9/1969 | Westeren et al. | 263/6 |
| 3,561,080 | 2/1971 | Hans-Karl Weinlein | 432/245 |
| 3,904,355 | 9/1975 | Takahashi | 432/152 |

OTHER PUBLICATIONS

Vol. 1, Industrial Furnaces 5th Edition by W. Trinks and M. H. Mawhinney–Section No. 7, Doors–16 pages of text.

*Primary Examiner*—Henry A. Bennet

*Attorney, Agent, or Firm*—John I. Iverson

[57] ABSTRACT

A curtain door for use at the charge or discharge openings of a metal reheating furnace the curtain door comprising a horizontal support bar extending across the furnace opening, a horizontal curtain hanger member removably attached to the horizontal support bar and supporting at least two spaced apart metal mesh curtains of unequal length, an insulation means depending from the horizontal support bar adjacent the furnace side of the metal mesh curtain nearest the furnace opening and means to vertically raise or lower the horizontal support bar.

7 Claims, 4 Drawing Sheets

CURTAIN DOOR FOR METAL REHEATING FURNACE

BACKGROUND OF THE INVENTION

This invention relates to curtain doors for use at the charge or exit ends of a metallurgical reheat furnace. It relates specifically to curtain doors which include at least two metal mesh curtains of unequal lengths and a separate insulating and door sealing means positioned between the furnace opening and metal mesh curtains to provide a furnace door which, when lowered to its closed position, is adaptable to stock of varying thickness with minimum heat loss from the reheat furnace.

In the past, furnace doors comprised either hinged solid doors for small furnaces, vertical lifting solid doors for large furnaces, or, in the case of smaller furnaces where doors would be open most of the time due to operators adding, rearranging or removing stock, chain doors were substituted for solid doors.

The vertical lifting solid doors used on the larger furnaces consist of reinforced frames lined with firebricks. Such doors are extremely heavy, difficult to operate and are subjected to various types of mechanical and thermal abuses. For example, it is common to have stock catch the bottom edge of such a door, pull it away from the furnace, and then drop it back against the door seats. Additionally, because doors are made to be opened and closed, they are subjected to constant thermal changes and the firebricks are cooled when the door is opened and reheated when the door is closed. Such treatment of furnace doors causes spalling and loosening of the firebricks and the loosened firebricks tend to catch on the furnace front and making it very difficult to raise or lower the furnace door. As a result, operators tend to keep furnace doors in a raised position, which causes furnace heat loss, higher operating costs and dangerously exposes furnace operators to extremely high temperatures.

In order to overcome the aforementioned problems related to the vertical lift solid doors which are currently in use on large reheating furnaces, a furnace door must be provided which is relevantly light in weight, unaffected by thermal variations, inexpensive to maintain and convenient for the furnace operators to use.

SUMMARY OF THE INVENTION

It is therefore an object of this invention to provide a furnace door having a flexible curtain which is convenient for use by being adaptable to a wide range of stock thickness when the furnace door is in its closed door position.

It is a further object of this invention to provide a furnace door support bar having a sealing means to prevent heat loss between the flexible curtain and the furnace opening.

It is still a further object of this invention to provide a furnace door support bar having a plurality of fasteners to facilitate hanging or removing sections of the flexible curtain.

It is still a further object of this invention to provide a thermal insulator between the flexible curtain and the furnace opening.

It is still a further object of this invention to provide means for vertically raising or lowering the furnace door support bar.

I have discovered that the foregoing objects can be attained with a furnace door assembly comprising a horizontal support bar extending across the entry or exit areas of a furnace the support bar having a plurality of upwardly pointing hooks and a sealing means comprised of a depending plate enclosed within a flexible insulating material, a plurality of curtain hanger members attached to the upwardly pointing hooks of the support bar and supporting at least two spaced apart curtains of unequal lengths, flexible blanket insulation adjacent the curtain nearest the furnace opening and depending from the sealing means of the support bar, and, means to vertically raise or lower the support bar of the furnace door assembly.

DESCRIPTION OF THE PREFERRED EMBODIMENT

Figure 1:
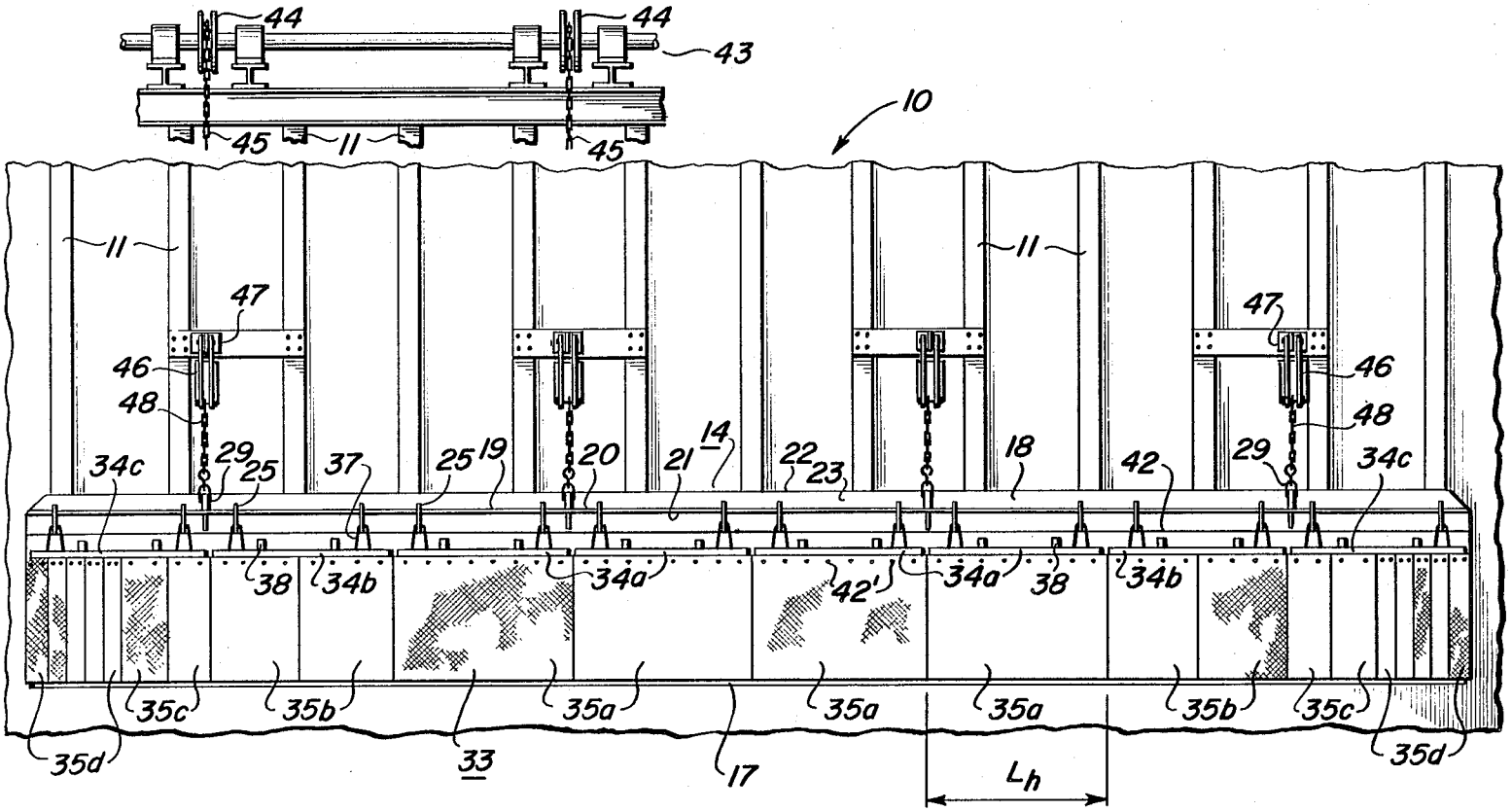
FIG. 1 is an elevational end view of a furnace showing the furnace door in its lowered position.
Figure 2:
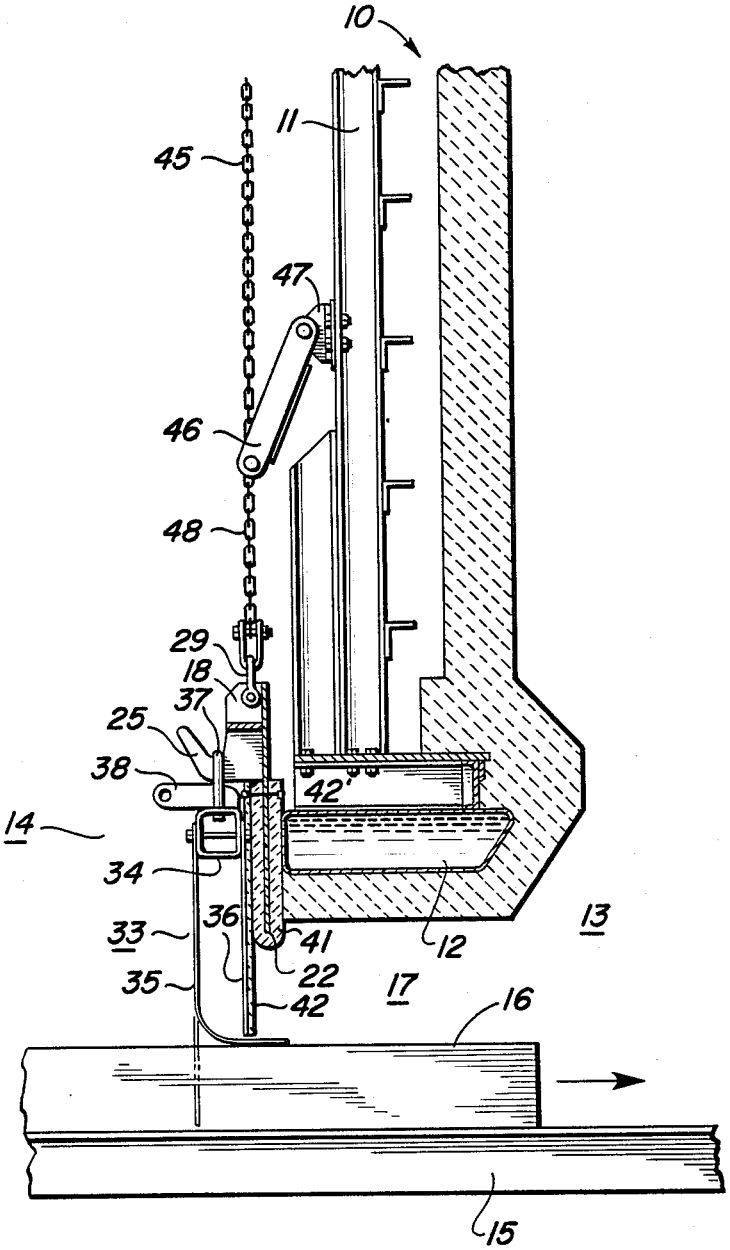
FIG. 2 is a cross-sectional view of the furnace door showing the furnace door in its closed position.

Referring to FIGS. 1 and 2 of the drawings, a metallurgical reheat furnace 10 constructed of insulating firebrick is shown to include a structural supporting framework 11, lintel 12, furnace interior 13, furnace end door assembly 14 and a stock conveying means 15. Furnace 10 is a continuous furnace and is of the type wherein stock 16 is continuously added to the furnace at the charge end opening 17 as the conveying means 15 advances previously charged stock through furnace interior 13 for eventual removal at the discharge end of furnace 10.

Even though the discharge end of furnace 10 is not shown in the drawings, and although the furnace doors 14 of the preferred embodiment of the invention are shown at the charge end 17 of furnace 10, it should be understood that the furnace door assembly 14 is suitable for use at the discharge end of furnace 10.

Figure 4:
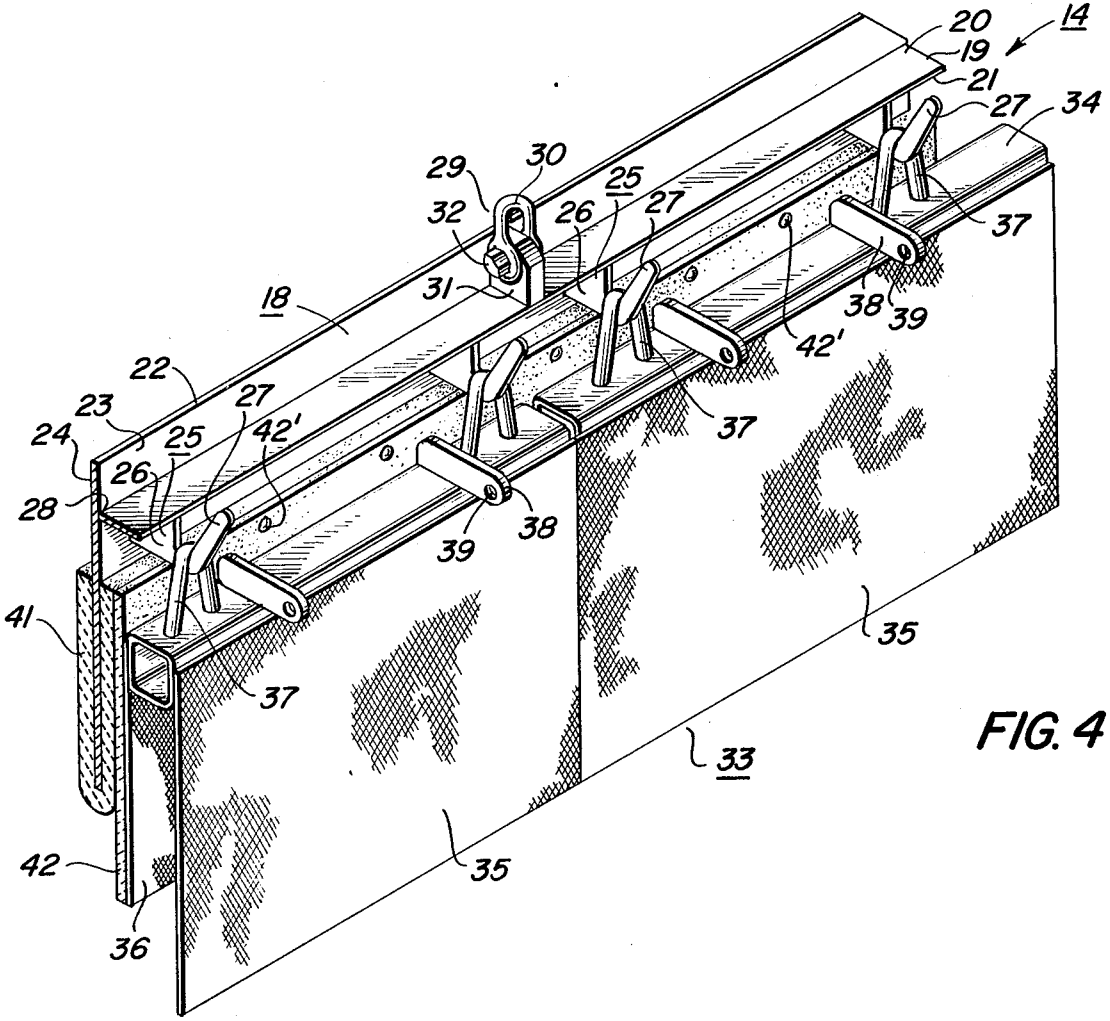
FIG. 4 is a fragmentary isometric view showing a section of the furnace door of the invention.

As shown more clearly in FIGS. 1 and 4 of the drawings, the furnace door assembly 14 includes a horizontal support bar assembly 18 extending across the opening of furnace 10. Support bar 18 is a weldment of various plates and includes a horizontal plate 19 having top and bottom surfaces 20 and 21, and a depending furnace seal plate 22 having front and furnace side surfaces 23 and 24. Plates 19 and 22 are fastened together along edge 28 forming an inverted "L" shaped horizontal support bar 18, and the depending surfaces 23 and 24 of plate 22 are covered with a "U" shaped insulating door seal means 41.

A plurality of curtain fasteners 25, and at least two shackle means 29, are spaced along the length of the horizontal support bar 18. Each curtain fastener 25 includes a rectangular portion 26 and a hook portion 27. The rectangular portion 26 of each curtain fastener 25 is attached to the bottom surface 21 and front surface 23 of plates 19 and 22 and the hook portion 27 is positioned to point in an upward direction away from furnace 10. Each shackle means 29 comprises a shackle 30, shackle plate 31 and fastener 32 and the shackle 30 is attached to pivotal arm 46 of a door lifting means 43, shown in FIG. 3, by chain or cable 48.

Wire mesh curtain units 33, comprising a curtain hanger member 34 and at least two metal mesh curtains 35 and 36 of unequal lengths, are suspended from the curtain fasteners 25 of horizontal support bar 18. As more clearly shown in FIG. 1, the metal mesh curtains 35 and 36 of the preferred embodiment are suspended from a plurality of curtain hanger members 34 and the metal mesh curtains 35 and 36 are symmetrically arranged about the longitudinal centerline of the furnace opening 17 in a variety of different widths to accommodate stock of different widths. For example, each of the four central curtain hanger members 34*a*, having a length $L_h$, are shown to include a single depending metal mesh curtain 35*a* having a width equal to length $L_h$. Located adjacent the two outside curtain hanger members 34*a* is a curtain hanger member 34b, and located adjacent each curtain hanger member 34*b*, is a curtain hanger member 34*c*. Each curtain hanger member 34*b* includes two depending metal mesh curtains 35*b* having a width $\frac{1}{2}L_h$, and each curtain hanger member 34*c* includes two metal mesh curtains 35*c* each metal mesh curtain 35*c* having a width $\frac{1}{4}L_h$, and five metal mesh curtains 35*d* each metal mesh curtain 35*d* having a width $1/10L_h$.

The symmetrical arrangement of the different width screens 35*a* through 35*d*, permits a furnace operator to select a path for the different stock widths which best matches a selected curtain area. Such a selected path enables the operator to choose a curtain area which will allow minimal opening of screens 35 and the least possible amount of heat loss and exposure to the operator.

Each curtain hanger member 34 includes at least two spaced apart "V" shaped hanger means 37 for attaching the curtain units 33 to the upwardly pointing hook portion 27 of curtain fasteners 25. Each curtain hanger member 34 also includes at least two spaced apart lifting bars 38. The lifting bars 38 are aligned perpendicular to the metal mesh curtain units 33 and are attached to the top surface of the curtain hanger member 34 by welding or other suitable means. Each lifting bar 38 includes an end portion extending beyond the top surface edge of hanger member 34 in a direction away from the furnace opening and the extended end portion of lifting bar 38 is provided with an opening 39 for attaching a lift hook 40 of a screen hoisting means (not shown). As shown more clearly in FIG. 3 of the drawings, opening 39 is positioned to cause the top surface of screen unit 33 to rotate in a direction toward the furnace opening as the screen hoisting means begins to lift the screen unit. This clockwise rotation causes the "v" shaped hanger means 37 of screen unit 33 to be pointed toward the horizontal support bar 18 in an upward pointing inclined position for easy attachment or removal to or from the hook portion 27 of the curtain fasteners 25. The clockwise rotation of screen unit 33 also causes the metal mesh curtains 35 and 36 to swing away from the furnace door assembly 14 and thereby prevent the mesh screens from becoming entangled with the various parts of the door assembly.

A blanket of flexible insulation 42, located adjacent to the furnace side of the shorter metal mesh curtain 36, is attached to plate 22 of the horizontal support bar 18 by fasteners 42' and extends from the top portion of the insulating door seal means 41 to the bottom edge of metal mesh curtain 36. The flexible blanket insulation 42 serves as a heat shield for the metal mesh curtains 35 and 36 and reduces heat loss at the furnace opening 17.

Figure 3:
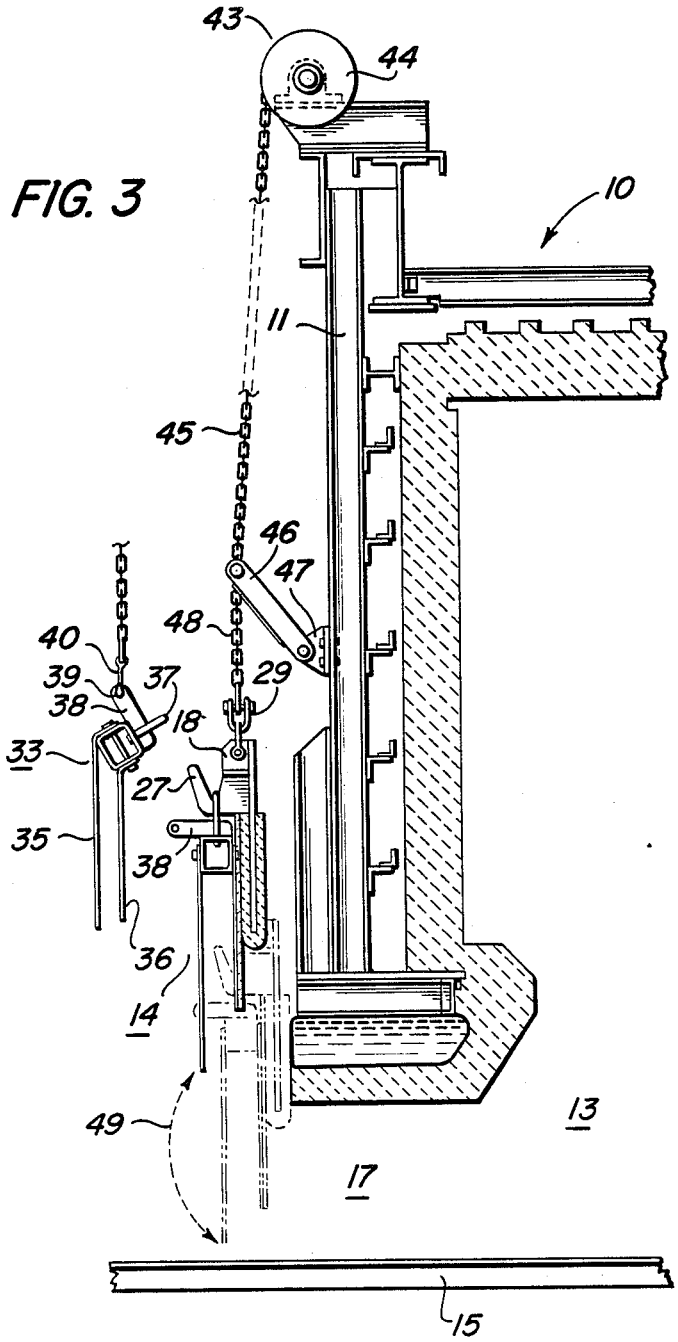
FIG. 3 is a cross-sectional view similar to FIG. 2 showing the furnace door in its raised position.

As shown in FIGS. 1 and 3, the door lifting means 43 is supported above the furnace opening 17 by the structural framework 11 of furnace 10. The door lifting means includes a plurality of spaced apart sheaves 44 corresponding to each shackle means 29 attached to the horizontal support bar 18 and each sheave is attached to a corresponding pivot arm 46, located between each sheave 44 and each shackle means 29, by chains or cables 45. The pivotal arms 46 are attached to the structural framework 11 of the furnace 10 by brackets 47 and a second length of chain or cable 48 attaches each pivotal arm 46 to a corresponding shackle means 29 located immediately below each pivot arm.

When the furnace door is raised to an opened position, as shown in FIG. 3, the upward movement pivot arms 46 cause the furnace door assembly 14 to follow a circular path 49 to its fully raised position. The circular movement of the door assembly 14 swings the door away from the furnace as the door is being raised and thereby prevents damage to the door by avoiding contact with the furnace structure. Conversely, when the door lifting means 43 is reversed to lower the door to its closed position, the furnace door assembly 14 again follows the same path 49 and contacts the furnace structure only when it has reached its fully closed position.

Although the invention has been illustrated and described in certain embodiments, it should be understood that other embodiments and changes may be made without departing from the scope of the invention as set forth. For example, the furnace door assembly could comprise a plurality of horizontal support bars and corresponding door raising means to permit raising or lowering separate sections of the furnace door along the width of the furnace opening and the curtain fasteners may be arranged to accommodate various combinations of metal mesh curtain sizes and arrangements.

I claim:

1. A curtain door for a metal reheating furnace comprising:

(a) a horizontal support bar extending across the entry end or exit end of said furnace, said horizontal support bar having a plurality of curtain fasteners and a depending plate member, (b) a plurality of curtain hanger members suspended from said curtain fasteners each curtain hanger member including at least two depending horizontally spaced apart metal mesh curtains of different lengths, (c) a door seal means encasing said depending plate member of said horizontal support bar, (d) flexible blanket insulation attached to said depending plate member of said horizontal support bar and adjacent to the shorter curtains of said spaced apart metal mesh curtains, and (e) means to either raise or lower said horizontal support bar along a circular path.

2. The invention of claim 1 in which the longer metal mesh curtains of said depending horizontally spaced apart metal mesh curtains are symmetrically arranged about the longitudinal centerline of said metal reheating furnace according to decreasing widths first said longer metal mesh curtains, adjacent to the said longitudinal centerline of said metal reheating furnace, comprising a width $L_h$ and last said longer metal mesh curtains, spaced farthest from said longitudinal centerline of said metal reheating furnace, comprising a width $1/10\ L_h$.

3. The invention of claim 1 in which the curtain hanger members (b) include at least two spaced apart hanger means for attachment to corresponding curtain fasteners of said horizontal support bar.

4. The invention of claim 1 in which the curtain hanger members (b) include at least two spaced apart lifting bars positioned to cause the top surface of said curtain hanger members to rotate toward the opening of said reheating furnace when said curtain hanger members are supported by said lifting bars.

5. The invention of claim 1 in which the curtain fasteners of said horizontal support bar include upwardly pointing hook portions.

6. The invention of claim 1 in which means (e) includes pivot arms to cause movement of said horizontal support bar along said circular path.

7. A curtain door for a metal reheating furnace comprising:

(a) at least two horizontal support bars extending across the entry end or exit end of said furnace, each said horizontal support bar having a plurality of curtain fasteners and a depending plate member, (b) a plurality of curtain hanger members suspended from said curtain fasteners of each said horizontal support bar each curtain hanger member including at least two depending horizontally spaced apart metal mesh curtains of different lengths, (c) a door seal means encasing said depending plate member of each said horizontal support bar, (d) flexible blanket insulation attached to said depending plate member of each said horizontal support bar and adjacent to the shorter curtains of said spaced apart metal mesh curtains, and (e) means to independently raise or lower each said horizontal support bar along a circular path.

* * * * *